US012286753B2

(12) United States Patent
Eberhardt et al.

(10) Patent No.: US 12,286,753 B2
(45) Date of Patent: Apr. 29, 2025

(54) CLOTHING

(71) Applicant: Voith Patent GmbH, Heidenheim (DE)

(72) Inventors: Robert Eberhardt, Ellwangen (DE); Tobias Englet, Aislingen (DE)

(73) Assignee: Voith Patent GmbH, Heidenheim (DE)

( * ) Notice: Subject to any disclaimer, the term of this patent is extended or adjusted under 35 U.S.C. 154(b) by 325 days.

(21) Appl. No.: 17/783,842

(22) PCT Filed: Nov. 11, 2020

(86) PCT No.: PCT/EP2020/081780

§ 371 (c)(1),
(2) Date: Jun. 9, 2022

(87) PCT Pub. No.: WO2021/121789

PCT Pub. Date: Jun. 24, 2021

(65) Prior Publication Data

US 2023/0013706 A1 Jan. 19, 2023

(30) Foreign Application Priority Data

Dec. 18, 2019 (DE) ..... 10 2019 134 837.4

(51) Int. Cl.
*D21F 7/10* (2006.01)
*D21F 7/08* (2006.01)

(52) U.S. Cl.
CPC ..... *D21F 7/10* (2013.01); *D21F 7/083* (2013.01)

(58) Field of Classification Search
CPC ..... D21F 7/10; D21F 7/083
See application file for complete search history.

(56) References Cited

U.S. PATENT DOCUMENTS

| | | | | |
|---|---|---|---|---|
| 4,698,250 | A | 10/1987 | Talonen et al. | |
| 6,440,881 | B1 | 8/2002 | Ercken | |
| 9,169,598 | B2 | 10/2015 | Straub et al. | |
| 2009/0133774 | A1 | 5/2009 | Ogiwara | |
| 2019/0112763 | A1 * | 4/2019 | Eberhardt | D21F 11/14 |

FOREIGN PATENT DOCUMENTS

| | | | | |
|---|---|---|---|---|
| DE | 3637179 | A1 | 5/1987 | |
| DE | 29904546 | U1 | 5/2000 | |
| DE | 102007004676 | A1 | 7/2008 | |
| DE | 102011079517 | A1 | 1/2013 | |
| EP | 1918453 | A1 | 5/2008 | |
| WO | 0223500 | A1 | 3/2002 | |
| WO | WO-2015024718 | A1 * | 2/2015 | D21F 7/10 |

* cited by examiner

*Primary Examiner* — Abbas Rashid
*Assistant Examiner* — Matthew M Eslami
(74) *Attorney, Agent, or Firm* — Laurence A. Greenberg; Werner H. Stemer; Ralph E. Locher

(57) ABSTRACT

A clothing or seamed felt for a pressing section of a machine producing a fibrous web includes at least one base structure and at least one staple fiber layer is disposed on the base structure. The staple fiber layer is disposed on a side facing the fibrous web and/or the machine. At least one seam zone has seam loops connected to one another by at least one pintle or seam wire making the clothing endless. The staple fiber layer is divided in the region of the seam zone by at least one cut forming a seam flap and a seam wedge or gusset. At least one connecting element is inserted between the seam flap and the seam wedge. The connecting element is materially connected, in particular welded, to staple fibers of the seam flap and/or of the seam wedge. A method for using the clothing is also provided.

14 Claims, 2 Drawing Sheets

CLOTHING

FIELD AND BACKGROUND OF THE INVENTION

The invention relates to a clothing, in particular a seamed felt for use in a pressing part of a machine for producing a fibrous web, wherein the clothing includes at least one base structure and at least one staple fiber layer disposed on the base structure, the at least one staple fiber layer is disposed on a side facing toward the fibrous web and/or on a side facing toward the machine, the clothing includes at least one seam zone in which seam loops are connected to one another by at least one pintle in order to make the clothing endless, and the at least one staple fiber layer is divided in the region of the seam zone by at least one cut forming of a seam flap and a seam wedge. The invention also relates to a method for using such a clothing.

In clothings for paper machines, particularly in press felts, development has already been moving away for some time from endless clothings to seamed clothings. An advantage for the user is that these seamed clothings are easier to install in the machine. In new systems, furthermore, significant construction outlay may be obviated when precautions do not need to be taken for putting on endless clothings.

Seamed felts, in particular, are in this case manufactured with a pintle seam which connects the felt ends in the region of their base woven fabric. A nonwoven layer is applied and stitched onto this base woven fabric which has thereby been made endless, at least onto the paper side—and often also onto the backing side. Since this is advantageous in terms of production technology, the nonwoven layer is in this case also stitched over the pintle seam.

In order to draw the felt into the paper machine, the seam of the felt must be reopened. This is readily possible in the case of the base woven fabric by removing the pintle. However, the nonwoven layers stitched over the seam must be separated.

For this purpose, the paper-side nonwoven layer of one felt end is separated by a cut in the region of the pintle from the paper-side nonwoven layer of the other felt end. The cut is introduced, after the stitching over the seam, into the nonwoven which is still closed at this time. This cut may be made perpendicularly, although it is preferably made slightly obliquely, i.e. preferably with a deviation of 5-30° from the perpendicular.

After the felt has been drawn in, the pintle seam is reclosed with a pintle, for example in the form of a fiber bundle. Although the nonwoven layers of the two felt ends in this case touch or overlap, the properties of the felt, for example its porosity, in this seam region are different to those of the rest of the felt.

In order to remedy this deficiency, several possibilities for optimizing the seam region are known from the prior art. For example, WO 02/35000 A1 proposes the introduction of a strip of flow-resistant material into the seam region of the clothing. As an alternative, EP 1 918 453 A1 and WO 2015/024718 describe the introduction of liquid material or small particles into the seam region.

All these optimizations of the seam region are used to modify the flow properties of this region, but they do not remedy the fundamental deficiency that the nonwoven overlay is permanently weakened at this position by the cut.

For example, the fiber anchoring in the seam region is less than in the remaining region of the felt surface due to the cut, particularly in the case of oblique cuts. Because of the generally unfavorable geometry of the felt seam for fiber anchoring because of the seam loops, and the fact that the seam loops must be kept substantially free of fibrous material in order to be able to pass the pintle through, although improvements to the fiber anchoring are possible, these possibilities are limited.

Furthermore, the cut is susceptible to damage since there is no fiber anchoring to the fibers on the other side of the nonwoven overlay directly in the region of the cut. According to experience, the felt wears more greatly in the seam region and a damaged seam region is often a cause of markings in the paper or of paper tears during the paper production. The cut is therefore a cause of shorter felt lifetimes, even though the felt outside the seam is still good enough to be used for several more days.

Furthermore, under tension of the felt, there is the risk that the gap over the seam will be widened and thus exposed to increased attack by abrasive contact elements or water jet nozzles in the paper machine.

SUMMARY OF THE INVENTION

It is an object of the present invention to overcome the problems of the prior art.

In particular, it is an object of the invention to propose a clothing which is more wear-resistant than the known clothings.

It is furthermore an object of the invention to propose a clothing whose seam has a reduced marking inclination than the known seamed clothings.

In particular, the possibility of achieving the advantageous effects without, or with only minor, modification of the permeability in the seam region is intended to be provided.

A method for using such a clothing is furthermore intended to be proposed.

The objects are entirely achieved by a clothing in which at least one connecting element is inserted between the seam flap and the seam wedge, and the at least one connecting element is materially connected, in particular welded, to staple fibers of the seam flap and/or of the seam wedge.

The objects are also achieved by a method for using a clothing in which the clothing is initially drawn into a pressing part of a machine for producing a fibrous web, before it is made endless by closing the pintle seam, and the at least one connecting element is subsequently connected, in particular welded, to staple fibers of the seam flap and/or of the seam wedge.

Further advantageous features of the embodiment according to the invention may be found in the dependent claims.

In respect of the clothing, the object is achieved by a clothing, in particular a seamed felt, for use in a pressing part of a machine for producing a fibrous web, wherein the clothing comprises at least one base structure and at least one staple fiber layer arranged on the base structure, which at least one staple fiber layer is arranged on a side facing toward the fibrous web and/or on a side facing toward the machine, wherein the clothing comprises at least one seam zone in which seam loops are connected to one another by at least one pintle in order to make the clothing endless, and wherein the at least one staple fiber layer is divided in the region of the seam zone by at least one cut with the formation of a seam flap and a seam wedge. According to the invention, at least one connecting element is inserted between the seam flap and the seam wedge, the at least one connecting element being materially connected, in particular welded, to staple fibers of the seam flap and/or of the seam wedge.

In the case of press felts, at least one staple fiber layer on a side facing toward the fibrous web is usual; staple fibers on the backing side facing toward the machine may also be provided in addition.

The terms "seam flap" and "seam wedge" are in this case taken from the terminology when using an oblique cut. For clothings having a perpendicular cut, which are explicitly also included by the invention, one or other cut ends of the nonwoven layer should respectively be denoted by these two terms.

In one particularly preferred embodiment, the connecting of the at least one connecting element to the staple fibers of the seam flap and/or of the seam wedge may be carried out by means of NIR transmission welding. For this purpose, it is naturally highly advantageous for the at least one connecting element to comprise or consist of a polymer material which at least mostly absorbs light with a wavelength in the NIR range of from 780 [nm] to 3 [μm]—preferably between 780 [nm] and 1300 [nm]. This is to be understood as meaning that the polymer material need not necessarily be absorbent over the entire NIR range between 780 nm and 1300 nm (or 3000 nm). It is quite sufficient for the polymer material to be at least mostly absorbent in one or more subranges of this NIR range. Light with a wavelength from this subrange may then be used for the welding.

The staple fibers of the nonwoven layer are in most cases made of a polyamide, which is substantially transparent for light from this wavelength range.

The seam zone with the at least one connecting element may therefore be irradiated—under a certain joining pressure—with light of the corresponding wavelength. A laser or another suitable source may be used as the light source. The connecting element absorbs the light, and is thereby heated and fully or partially melted, so that a materially bonded connection is formed between the connecting element and the staple fibers touching it. The staple fibers are in this case heated essentially only by the contact with the connecting element. The staple fibers of the nonwoven layer thereby remain almost unchanged by the joining process. Significant changes in the permeability or porosity of the seam region therefore do not occur during the joining process.

This positive property results automatically in the case of transmission welding, while in the case of a connecting which is also possible, for example by means of adhesive bonding or ultrasonic welding, the joining process must be controlled very accurately.

The absorption properties of the connecting element may, for example, be achieved by adding an absorber additive to the connecting element. Carbon black, for example, is suitable for this. Absorbers with different colors, and even transparent absorbers, are however available on the market, for example from the company Clearweld (www.clearweld-.com).

Either the additives may be added to the polymer compound or they may be used as a coating of the connecting element.

By means of absorber additives, it is possible to produce connecting elements from the same polymer material as that of which the staple fibers of the nonwoven consist—usually a polyamide, and nevertheless to use the advantageous technique of NIR transmission welding. The material uniformity leads to particularly good and long-lasting welded connections.

It is particularly advantageous if, after the joining, that is to say in particular after the welding, the at least one connecting element is materially connected to staple fibers both of the seam flap and of the seam wedge. The two edges of the cut are thereby firmly connected to one another, so that the fiber anchoring is improved and the seam becomes more wear-resistant. Stretching of the nonwoven layer under tensile stress is prevented, so that the marking inclination of the seam is also reduced.

Attempts by the Applicant to improve the seam have surprisingly revealed that the use of connecting elements gives much better results than are possible by simple connecting, for example welding of the two edges of the cut to one another.

This is to be understood in that without a connecting element, there are contact points and therefore connecting positions between the two edges of the cut only when a staple fiber of one edge randomly touches a staple fiber of the other edge. The joining connections achievable in this way are therefore generally only very weak.

In the clothings proposed here, a connecting element inserted into the seam acts as a bridge between the contact points of the two edges. The likelihood that each of the two edges will have a number of points of contact with the connecting element, and therefore that a firm joining connection will be formed, is much higher than without using a connecting element.

The user has relatively great freedom in the selection of the connecting element—or optionally also of a multiplicity of connecting elements in a seam—as will be discussed in more detail below. In this case, it is possible to select the connecting elements in such a way that the permeability of the seam is scarcely affected but a firm connection is nevertheless formed.

If, on the other hand, precisely such properties of the seam are intended to be influenced, this is likewise possible by means of selecting other connecting elements.

The clothings according to the various aspects of the present concept thus allow the user a very flexible design in the seam region.

A method for using a clothing according to the invention may consist in initially drawing the clothing into a pressing part of a machine for producing a fibrous web, and then making it endless by closing the pintle seam. For known seamed clothings, the process ends here. In the case of a clothing as proposed here, it is subsequently possible to connect, in particular weld, the at least one connecting element to staple fibers of the seam flap and/or of the seam wedge.

Such a method may be carried out in different variants.

In one variant, the at least one connecting element is inserted between the seam flap and the seam wedge, and subsequently materially connected, only after the clothing has been drawn into the machine, in particular after making it endless by means of a pintle.

In another variant, the at least one connecting element may be provisionally connected to the seam wedge or the seam flap before drawing into the machine. Here, "provisionally" means that in this embodiment, although the connecting element has a connection to the seam flap or wedge before drawing into the machine, this connection is not however the future materially bonded connection. Such provisional connections may, for example, be form-fit connections (for instance light stitching or pointwise sewing), or an adhesively bonded connection, in particular using a water-soluble adhesive which can be washed away during subsequent operation of the machine. This has the advantage that the connecting element/elements are placed at the correct position, since the personnel who draw the clothings in usually do not have the knowledge and technical skill needed for this.

Alternatively, in a further variant the at least one connecting element may already be materially connected to the seam wedge or the seam flap before drawing into the machine. An advantage in this case is that slipping of the connecting element when drawing in can almost be ruled out by this permanent joining connection. On the other hand, this method requires two joining processes—for example welding processes, which may have a disadvantageous effect. The advantage or the disadvantage may be more important depending on the application.

In one advantageous embodiment, the at least one connecting element may be configured as a thread-shaped or band-shaped connecting element.

Thread-shaped refers to a connecting element in which the thickness and the width are similar, while the longitudinal extent is much greater.

In the case of a thread-shaped embodiment, the connecting element may in particular be configured as a monofilament, a multifilament bundle or as a twine.

Band-shaped refers to a connecting element in which the width is much greater than the thickness, and the longitudinal extent is in turn much greater than the width.

In the case of a band-shaped embodiment, the at least one connecting element may in particular be configured as textile band, as a nonwoven, sheet or foam.

A textile band may for example be a woven fabric, a knitted fabric or a knotted fabric. A nonwoven may, for example, be a so-called meltblown nonwoven.

Preferably, the thread-shaped or band-shaped connecting element may have a length of 10 mm or more, in particular more than 20 mm, in the longitudinal direction. A greater length of the connecting element improves the above-described bridging effect of the connecting element.

In general, it is advantageous for one or more connecting elements to be distributed substantially over the entire length of the cut (in the CD direction).

This may be achieved, on the one hand, in that one or more connecting elements extend over a large part of the length of the cut.

When using a plurality of connecting elements, all these connecting elements may be identical. As an alternative, it is also conceivable for different types of connecting elements to be inserted into the cut.

In particular, a thread-shaped or band-shaped connecting element may extend over at least half of the width, preferably the entire width, of the clothing in the transverse direction of the machine. In order to avoid confusion, it should again be explained here that the longitudinal direction or length direction of the connecting element in this case extends essentially along the cut and therefore in the transverse direction (CD) of the clothing.

Since modern clothings may have a width of 10 m or more, in this case the length of the thread-shaped or band-shaped connecting elements is much more than the 10 mm or 20 mm described above.

The length of the connecting elements may then lie in the range of several meters instead (for example more than 2 m or even more than 5 m).

As an alternative or in addition, a multiplicity of connecting elements may be provided, which are configured for example in the form of staple fibers that are introduced into the cut.

Advantageously, these fibers may be configured in such a way that they at least mostly absorb light with a wavelength in the NIR range of from 780 [nm] to 3 [μm].

Particularly preferably, these fibers may be configured in such a way that they at least mostly absorb light having a wavelength in the NIR range of from 780 [nm] to 1300 [μm], since in the range beyond 1300 [nm] the risk increases that materials of the staple fibers or of the base structure will absorb this light to a certain extent, which in many cases is not desired.

Further advantageous characteristics of the invention will be explained on the basis of exemplary embodiments with reference to the drawings. The features mentioned may advantageously be implemented not only in the combination presented, but also individually combined with one another.

DETAILED DESCRIPTION OF THE INVENTION

The figures will be described in more detail below.

Figure 1:
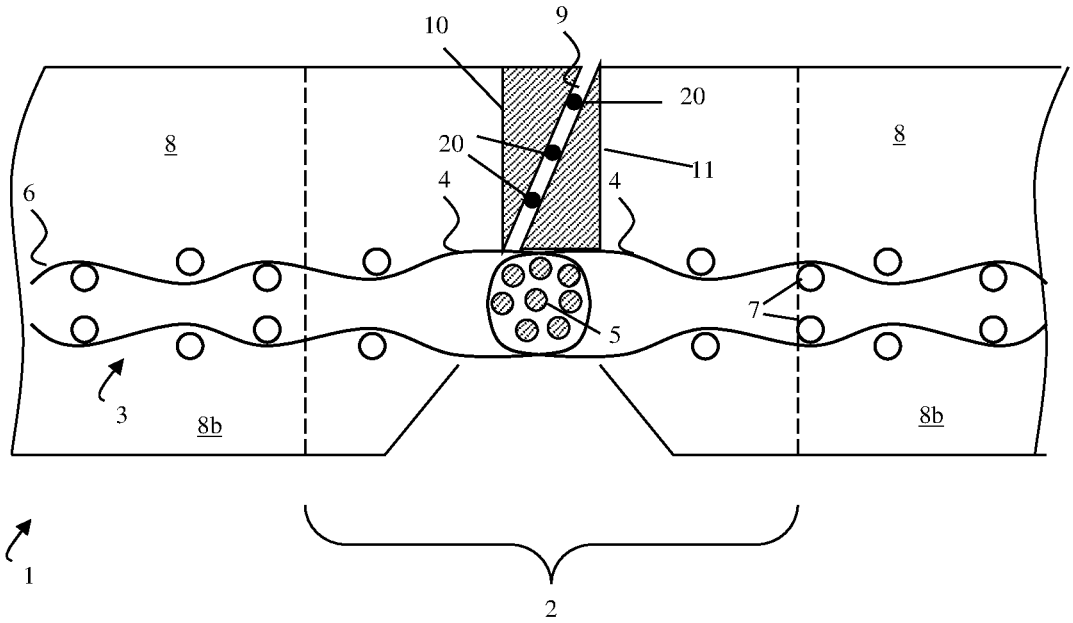
FIG. 1 shows a detail of a clothing according to one aspect of the invention

FIG. 1 shows a detail of a clothing 1 according to one aspect of the invention. Here, in particular, a seam zone 2 is also depicted. The clothing in this case comprises a base structure 3, which is configured as a base woven fabric 3. The respective ends of the base structure respectively comprise a seam loop 4. Such seam loops 4 may, for example, be formed by folding and superimposing the base structure 3. In this case, the seam loops 4 are formed by the longitudinal yarns 6 (MD yarns) of the base woven fabric 3. In order to form the seam loops 4, individual transverse yarns 7 (CD yarns) of the base woven fabric may also be removed. The clothing 1 is made endless by the two seam loops 4 interleaving one another and by feeding in a pintle 5. The pintle 5 may in this case be a single filament. The clothing 1 in FIG. 1 shows, as an alternative, a pintle 5 which is formed by a multiplicity of filaments. When selecting the suitable pintle 5, the person skilled in the art is in other regards entirely free. The advantages of the present invention may be achieved independently of the selection of the pintle 5.

The clothing 1 furthermore comprises two staple fiber layers 8, 8*b*. The staple fiber layer 8*b* on the backing side may in this case optionally also be omitted. The staple fiber layer 8 on the paper side is applied, in particular stitched, continuously on the base structure 3. In order to be able to open the clothing 1 for drawing into the machine, the staple fiber layer 8 has been opened over the seam by a cut 9. This cut 9 may in principle be made perpendicularly. Conventionally, however, as shown in FIG. 1, the cut 9 is made obliquely, that is to say with a certain angle with respect to the perpendicular. This angle is advantageously between 5° and 30°. A seam flap 10 and a seam wedge 11 are thereby formed. The seam flap 10 in this case overlaps the seam wedge 11 in the closed clothing.

In the embodiment according to FIG. 1, by way of example three connecting elements 20 are now inserted into the cut. These connecting elements 20 are respectively configured as threads which extend over the entire transverse direction of the clothing 1, or of the cut 9. For example, monofilaments, multifilament bundles or twines may be used as threads 20. More or fewer than the three threads 20 shown may also be used.

The connecting elements 20 may be distributed uniformly over the height of the cut 9. As an alternative, a nonuniform distribution may also be advantageous, for example in such a way that more connecting elements 20 are arranged in the vicinity of the base structure 3 than in the direction of the paper side, or vice versa.

When using a plurality of connecting elements 20, all these connecting elements 20 may be identical. As an alternative, it is also conceivable for different types of connecting elements 20 to be inserted into the cut 9.

These threads 20 are materially connected both to the seam flap 10 and to the seam wedge 11. This materially bonded connection may, for example, be a welded connection. It is thus highly advantageous for the connecting elements 20—i.e. in this case the threads 20—to consist of a polymer which at least mostly absorbs light in a suitable NIR wavelength range of from 780 [nm] to 1300 [nm]. The material from which, for example, press felts are made in the seam region (generally PA6 or PA66) is substantially transparent in this wavelength. The welded connection may therefore be produced very easily by means of NIR transmission welding. It is more particularly advantageous to use the same polymer (for example PA6 or PA66), which has the advantageous absorption property only due to the added absorber additives, for the connecting elements 20 as for the staple fibers 8. By such material uniformity of the connecting element 20 and the staple fibers 8, particularly durable welded connections may be achieved. As an alternative, however, suitable thermoplastics, for example copolyamides, PEBA or thermoplastic polyurethanes, which have a good compatibility with the material of the staple fiber layer 8, 8*b*, may also be used for the connecting elements 20.

As shown in FIG. 1, the backing-side staple fiber layer 8*b* has a sizeable break in the seam region 2. For example, this makes it easier to feed in the pintle 5 and impairs the quality of the paper produced minimally, if at all. It is, however, also conceivable within the scope of this invention for the staple fiber layer 8*b* on this side to be treated in the same way as on the paper side. This means that the staple fiber layer 8*b* on the backing side may be connected over the seam by inserting connecting elements 20.

Figure 2:
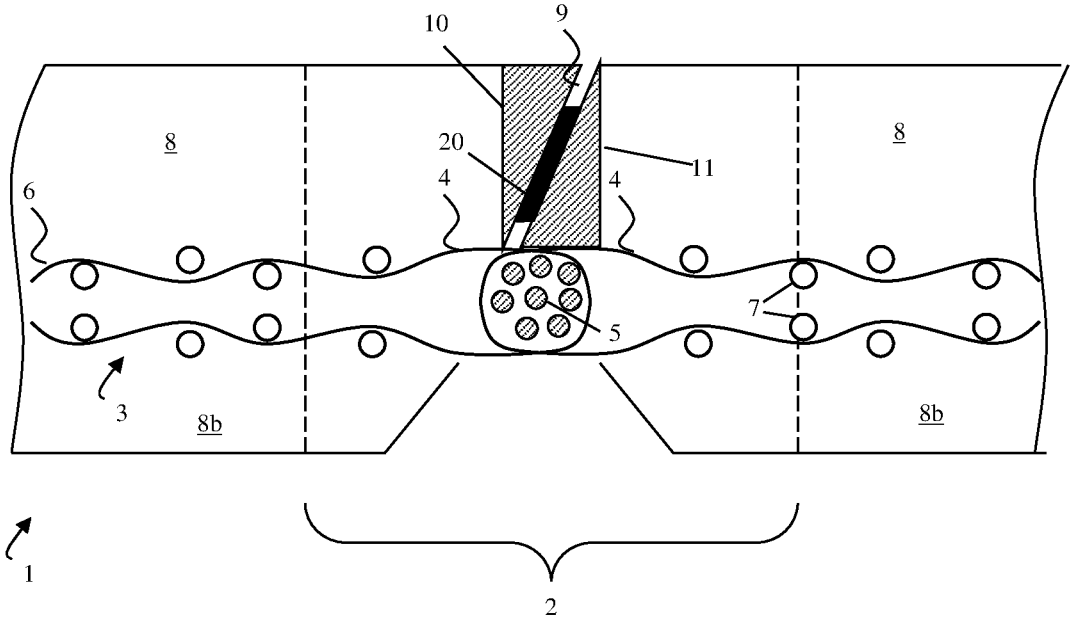
FIG. 2 shows a detail of a clothing according to a further aspect of the invention

The clothing 1 represented in FIG. 2 differs from the embodiment of FIG. 1 only by the selection of the connecting element 20. In FIG. 2, a single band-shaped connecting element 20 is in this case provided. The band-shaped connecting element 20 may for example be a nonwoven, a foam, a sheet or a woven fabric band, which may in particular again extend over the entire width of the felt 1, or of the cut 9. In the case of band-shaped connecting elements 20, particularly in the case of sheets 20, it is recommendable to select very thin sheets which do not, or only very slightly, influence the permeability of the seam zone 20. A sheet may, for example, be tailored in such a way that its length coincides with the felt width and its width coincides with the height of the cut 9. The dewatering in the depth direction of the felt 1 is therefore scarcely affected by the small sheet thickness, although the nonwoven anchoring is improved by the sheet. Sheets or films with a thickness of up to 50 μm are preferably selected. In particular, permeable or perforated sheets are advantageous. The sheets or films may be non-orientated, or may be monoaxially or biaxially orientated.

It is also possible for an entirely or substantially sheet or film to be inserted into the cut 9, and for the permeability of this sheet to be formed only by the continuous sheet structure being interrupted by the welding process (for example by melting).

Figure 3:
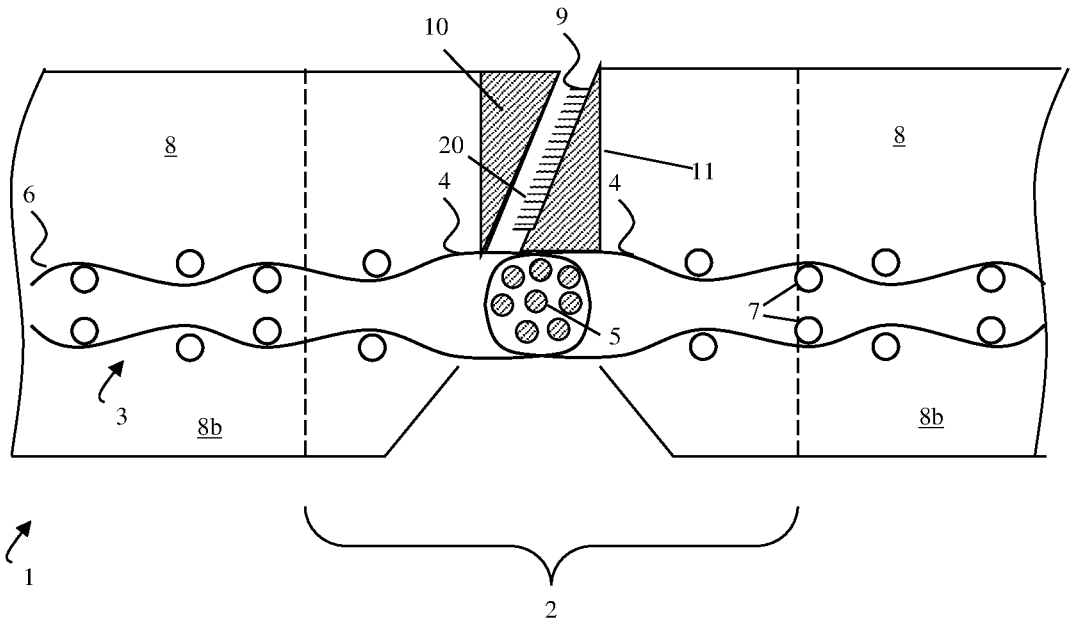
FIG. 3 shows a detail of a clothing according to a further aspect of the invention

FIG. 3 represents a clothing 1 in which the connecting element 20 is produced by flocking of the seam wedge 11. As an alternative or in addition, flocking of the seam flap 10 may also be carried out. The flock fibers 20 are in this case advantageously configured to be absorbent in the NIR wavelength range. The flocking leads to a connection between the connecting element and the seam wedge 11. This connection, however, is usually provisional. When the cut 9, which is still represented as being open in FIG. 3, is closed—optionally with the application of a joining pressure, then the materially bonded connection to the seam wedge 11 and/or to the seam flap 10 may be produced by a welding process—preferably by transmission welding.

Figure 4:
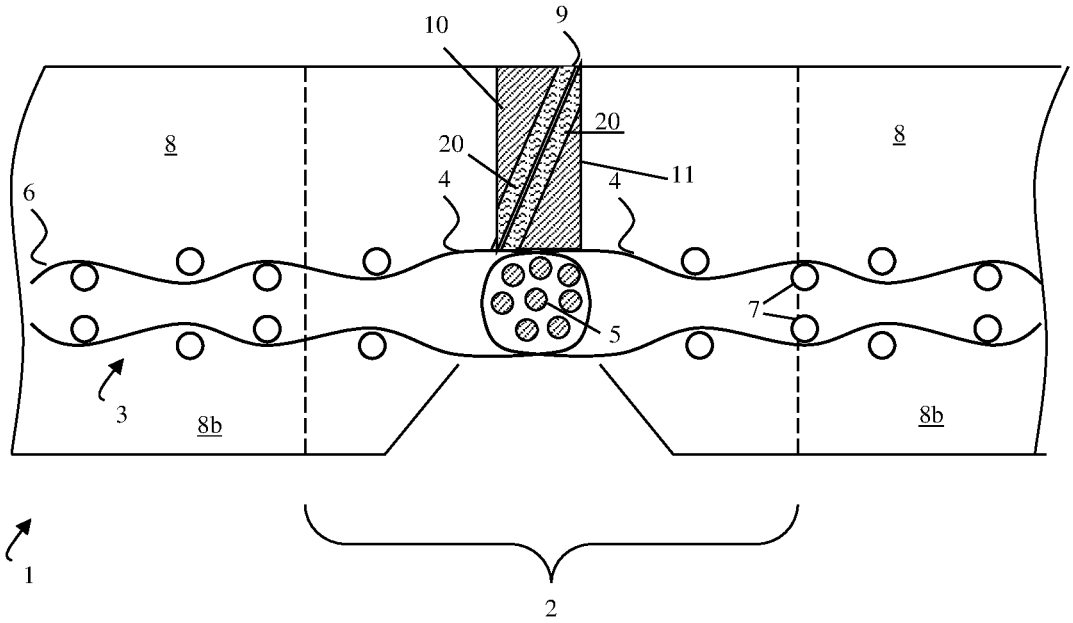
FIG. 4 shows a detail of a clothing according to a further aspect of the invention

FIG. 4 lastly shows an embodiment in which staple fibers that are absorbent in the NIR wavelength range have deliberately been introduced as a connecting element 20 into the staple fiber layer 8 in the region of the cut 9. The materially bonded connecting may again be carried out by welding. As one option, the absorbent staple fibers may already be introduced during the production of the nonwoven layer 8. As an alternative, they may also be added to the seam wedge 11 and/or the seam flap 10 subsequently, that is to say after producing the cut 9. Advantageously, these absorbent staple fibers in the seam flap 10 and/or in the seam wedge 11 may be distributed over the entire width of the clothing 1 and over a region of from 1 mm to 20 mm, in particular from 2 mm to 10 mm, thereof in the longitudinal direction. Absorbent fibers may also be provided in a larger region of the staple fiber layer 8, 8*b*. In particular, it is also possible for absorbent fibers to be distributed over the entire staple fiber layer 8, especially the entire staple fiber layer on the paper side.

The figures shown are intended to indicate the versatile possibilities of the present invention. The invention is not, however, restricted to these embodiments.

LIST OF REFERENCES

1 clothing
2 seam zone
3 base structure
4 seam loops
5 pintle
6 yarn in longitudinal direction (MD)
7 yarn in transverse direction (CD)
8, 8*b* staple fiber layer
9 cut
10 seam flap
11 seam wedge
20 connecting element

The invention claimed is:

1. A clothing for use in a pressing part of a machine for producing a fibrous web, the clothing comprising:

at least one base structure;

at least one staple fiber layer disposed on said at least one base structure, said at least one staple fiber layer disposed on at least one of a side facing toward the fibrous web or a side facing toward the machine;

at least one seam zone having seam loops;

at least one pintle interconnecting said seam loops make the clothing endless;

said at least one staple fiber layer having at least one cut in a region of said seam zone, said at least one cut dividing said at least one staple fiber layer and forming a seam flap and a seam wedge;

at least one connecting element inserted between said seam flap and said seam wedge, said at least one connecting element having a shape of a thread, a monofilament, a multifilament bundle or a twine, said at least one connecting element extending over between half of a width and all of the width of the clothing in a transverse direction of the machine, and said at least one connecting element being welded to staple fibers of at least one of said seam flap or said seam wedge; and said at least one connecting element including a polymer material at least mostly absorbing light with a wavelength in a near infrared (NIR) range of from 780 nm to 3 μm.

2. The clothing according to claim 1, wherein said polymer material at least mostly absorbs light with a wavelength in a NIR range of from 780 nm to 1300 nm.

3. The clothing according to claim 1, wherein said at least one connecting element has a length of 10 mm or more in a longitudinal direction.

4. The clothing according to claim 1, wherein said at least one connecting element has a length of more than 20 mm in a longitudinal direction.

5. The clothing according to claim 1, wherein said at least one connecting element has a length of more than 2 m in a longitudinal direction.

6. The clothing according to claim 1, wherein said at least one connecting element includes a multiplicity of connecting elements being welded to said staple fibers of at least one of said seam flap or said seam wedge and inserted between said seam flap and said seam wedge.

7. A method for using a clothing in a pressing part of a machine for producing a fibrous web, the method comprising: providing the clothing according to claim 1; initially drawing the clothing into the pressing part of the machine for producing the fibrous web, before making the clothing endless by closing a pintle seam; and subsequently welding said at least one connecting element to said staple fibers of at least one of said seam flap or said seam wedge.

8. The method according to claim 7, which further comprises connecting the at least one connecting element by using NIR transmission welding.

9. A clothing for use in a pressing part of a machine for producing a fibrous web, the clothing comprising:

at least one base structure;

at least one staple fiber layer disposed on said at least one base structure, said at least one staple fiber layer disposed on at least one of a side facing toward the fibrous web or a side facing toward the machine;

at least one seam zone having seam loops;

at least one pintle interconnecting said seam loops make the clothing endless;

said at least one staple fiber layer having at least one cut in a region of said seam zone, said at least one cut dividing said at least one staple fiber layer and forming a seam flap and a seam wedge;

at least one connecting element inserted between said seam flap and said seam wedge, said at least one connecting element having a shape of a band, a textile band, a nonwoven, a sheet or a foam, said at least one connecting element extending over between half of a width and all of the width of the clothing in a transverse direction of the machine, and said at least one connecting element being welded to staple fibers of at least one of said seam flap or said seam wedge; and said at least one connecting element including a polymer material at least mostly absorbing light with a wavelength in a near infrared (NIR) range of from 780 nm to 3 μm.

10. The clothing according to claim 9, wherein said polymer material at least mostly absorbs light with a wavelength in a NIR range of from 780 nm to 1300 nm.

11. The clothing according to claim 9, wherein said at least one connecting element has a length of 10 mm or more in a longitudinal direction.

12. The clothing according to claim 9, wherein said at least one connecting element has a length of more than 20 mm in a longitudinal direction.

13. The clothing according to claim 9, wherein said at least one connecting element has a length of more than 2 m in a longitudinal direction.

14. The clothing according to claim 9, wherein said at least one connecting element includes a multiplicity of connecting elements being welded to said staple fibers of at least one of said seam flap or said seam wedge and inserted between said seam flap and said seam wedge.

* * * * *